US008398186B2

(12) United States Patent
Higami

(10) Patent No.: US 8,398,186 B2
(45) Date of Patent: Mar. 19, 2013

(54) REFRIGERATOR

(75) Inventor: Kazuya Higami, Shiga (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/992,863

(22) PCT Filed: Aug. 27, 2009

(86) PCT No.: PCT/JP2009/004180

§ 371 (c)(1),
(2), (4) Date: Nov. 15, 2010

(87) PCT Pub. No.: WO2010/023927

PCT Pub. Date: Mar. 4, 2010

(65) Prior Publication Data

US 2011/0062844 A1 Mar. 17, 2011

(30) Foreign Application Priority Data

Aug. 27, 2008 (EP) ..... 08163058

(51) Int. Cl.
*A47B 96/04* (2006.01)

(52) U.S. Cl. ..... 312/405

(58) Field of Classification Search ..... 312/324, 312/326, 329, 405, 407, 348.4, 348.6; 62/440, 62/441, 447; 49/460, 501
See application file for complete search history.

(56) References Cited

U.S. PATENT DOCUMENTS

| | | | | |
|---|---|---|---|---|
| 5,411,328 | A * | 5/1995 | You | 312/405 |
| 5,740,587 | A * | 4/1998 | Onai et al. | 16/412 |
| 7,240,511 | B2 | 7/2007 | Lee et al. | |
| 7,240,512 | B2 * | 7/2007 | Lee et al. | 62/353 |
| 7,343,757 | B2 * | 3/2008 | Egan et al. | 62/389 |
| 7,506,474 | B2 | 3/2009 | Yoshikawa et al. | |
| 2004/0093799 | A1 | 5/2004 | Yoshikawa et al. | |
| 2005/0178145 | A1 | 8/2005 | Lee et al. | |
| 2005/0183441 | A1 | 8/2005 | Lee et al. | |
| 2007/0216272 | A1 * | 9/2007 | Park | 312/405 |
| 2010/0170279 | A1 * | 7/2010 | Aoki | 62/264 |
| 2011/0273071 | A1 * | 11/2011 | Kim et al. | 312/405 |

FOREIGN PATENT DOCUMENTS

| | | |
|---|---|---|
| CN | 2583586 | 10/2003 |
| CN | 1731053 | 2/2006 |
| EP | 1559974 | 8/2005 |
| JP | 06-221747 | 8/1994 |
| JP | 2003-003731 | 1/2003 |
| JP | 2003-336427 | 11/2003 |
| JP | 2005-214622 | 8/2005 |

OTHER PUBLICATIONS

English translation of JP2006046837 which is a publication of CN1731053.*

* cited by examiner

*Primary Examiner* — James O Hansen
*Assistant Examiner* — Daniel Rohrhoff
(74) *Attorney, Agent, or Firm* — Hamre, Schumann, Mueller & Larson, P.C.

(57) ABSTRACT

The refrigerator includes the following parts. A heat-insulating main body has openings in a front side. A divider divides inside of the heat-insulating main body into side by side so as to form a first storage compartment and a second storage compartment having a width smaller than a width of the first storage compartment. The first door turns to open and close at the first storage compartment, and has a vertical axis that extends in an anterior portion of a side wall of the heat-insulating main body. The second door turns to open and close at the second storage compartment, and has a vertical axis that extends in an anterior portion of a side wall of the heat-insulating main body. A concavity part is vertically provided at a front side of an free end of the first door.

4 Claims, 4 Drawing Sheets

REFRIGERATOR

TECHNICAL FIELD

The present invention relates to a refrigerator having two storage compartments arranged side by side, each having a door opening and closing at the corresponding compartment.

BACKGROUND ART

Conventionally, there have been used refrigerators each having a shape of a vertically long cuboid, in each of which a divider arranged at a middle section of a width direction separates inside of the refrigerator, providing different storage components side by side. In such a refrigerator, one storage component serves as a refrigerator compartment and the other storage compartment serves as a freezer compartment. Here, the refrigerator compartment has a width greater than a width of the freezer compartment, so that the refrigerator compartment has a more storage capacity than the freezer compartment. This refrigerator has two doors to open and close the refrigerator compartment and the freezer compartment, respectively. Although these two doors have the almost same height and thickness, the door of the refrigerator compartment has a width greater than a width of the door of the freezer compartment (refer to Japanese Unexamined Patent Application Publication No. 2005-214622, for example).

Recently, however, sizes of refrigerators have been increased. With the size increase, doors provided to the refrigerators are also enlarged, increasing weights of the doors. Moreover, such an enlarged door increases an amount of storage items which can be placed in door bins provided at the rear side of the door. As a result, a huge load is applied on a hinge every time of opening and closing the door to use the refrigerator.

If a thickness of such a door is decreased, a weight of the door can be reduced. However, a door of a decreased thickness has a drawback of poor heat insulation properties.

SUMMARY OF INVENTION

Technical Problem

In order to address the above-described problems, an object of the present invention is to provide a refrigerator having a door of a reduced weight, while keeping heat insulation properties.

Solution to Problem

In accordance with an aspect of the present invention for achieving the object, there is provided a refrigerator including: a heat-insulating main body having openings in a front side; a divider which divides inside of the heat-insulating main body into side by side so as to form a first storage compartment and a second storage compartment having a width smaller than a width of the first storage compartment; a first door which turns to open and close at the first storage compartment, and has a vertical axis that extends in an anterior portion of a side wall of the heat-insulating main body; and a second door which turns to open and close at the second storage compartment, and has a vertical axis that extends in an anterior portion of a side wall of the heat-insulating main body, and the refrigerator further including a concavity part which is vertically provided at a front side of an free end of the first door.

With the above structure, it is possible to reduce a weight of the first door having a relatively great width. Further, since the concavity part is provided at the free end of the first door to be the farthest from the axis, the moment of force of the first door is reduced. As a result, the first door can be easily opened and closed. Furthermore, there is the divider at the rear side of the end part at which the concavity part is arranged. Therefore, even if the concavity part is formed in the first door, a weight of the first door can be reduced without considerably damaging the heat insulation properties of the whole refrigerator.

It is preferable that the refrigerator further includes an interface device which is provided in the concavity part to convey information between a user and the refrigerator.

With the above structure, a recess part is not necessary in the first door to set the interface device therein, thereby preventing damage of the heat insulation properties of the first door. In addition, the interface device is located at the middle of a width of the front side of the refrigerator, so that the user can easily see and operate the interface device.

It is preferable that the interface device includes a touch screen.

With the above structure, when the user touches the touch screen, the touch screen can provide the user with information corresponding to the information displayed on the screen. Therefore, the interface device does not need to have plural switches to provide plural pieces of information, which can reduce a weight of the interface device.

It is preferable that the refrigerator further includes a first recess part which is provided in an edge part of the free end of the first door, and is recessed in a direction from the concavity part to the axis of the first door; and a second recess part which is provided in an edge part of a free end of the second door, and is recessed in a direction from the concavity part to the axis of the second door.

Since the first door has the concavity part at its free end, there is a space between neighboring first and second doors, into which user's fingers can be inserted. As a result, the user can grip by fingers the first recess part and the second recess part.

Therefore, without adding handles outwardly protruding from the first and second doors, the user can open and close the first and second doors at positions farthest from the respective axes. As a result, the first and second doors with such recess parts have a weight less than a weight of the doors with handles, thereby reducing a load on the user opening and closing the doors. In addition, while simplifying design of the front side of the refrigerator, the refrigerator can include the recess parts each having a great structural strength.

Moreover, the first recess part as well as the concavity part can reduce a weight of the first door. Likewise, the second recess part as well as the concavity part can also reduce a weight of the second door.

Advantageous Effects of Invention

Accordingly, the present invention can reduce a weight of a door to reduce a load on a hinge and a load on a user opening and closing the door, while suppressing reduction in heat insulation properties of the door. In addition, the present invention can improve visibility of the interface device, thereby giving the user impression of simplicity.

DESCRIPTION OF EMBODIMENTS

The following describes an preferred embodiment according to the present invention with reference to the drawings.

Figure 1:
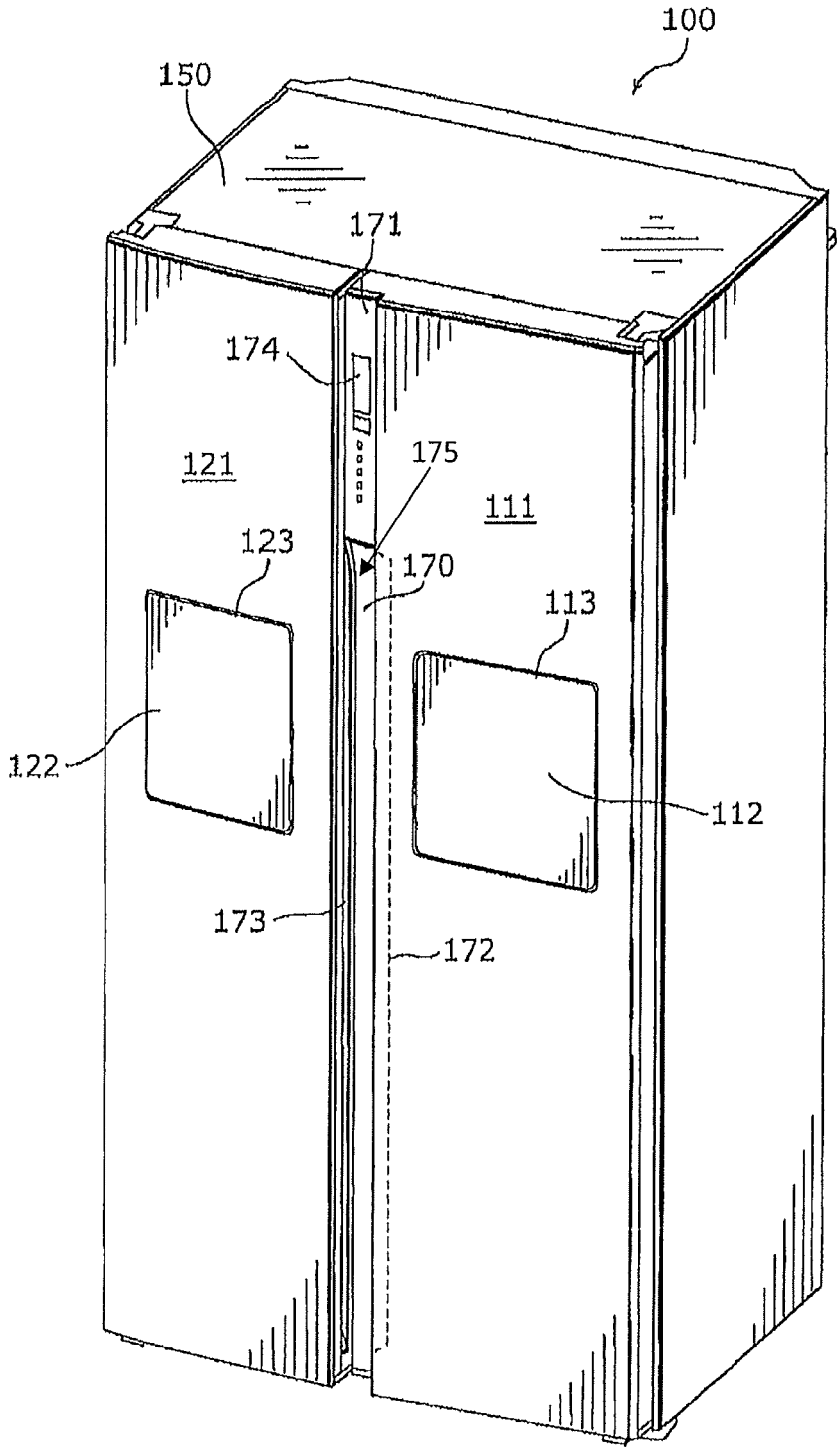
FIG. 1 is an external perspective view of a refrigerator according to an embodiment of the present invention.

FIG. 1 is an external perspective view of a refrigerator according to the embodiment of the present invention.

Figure 2:
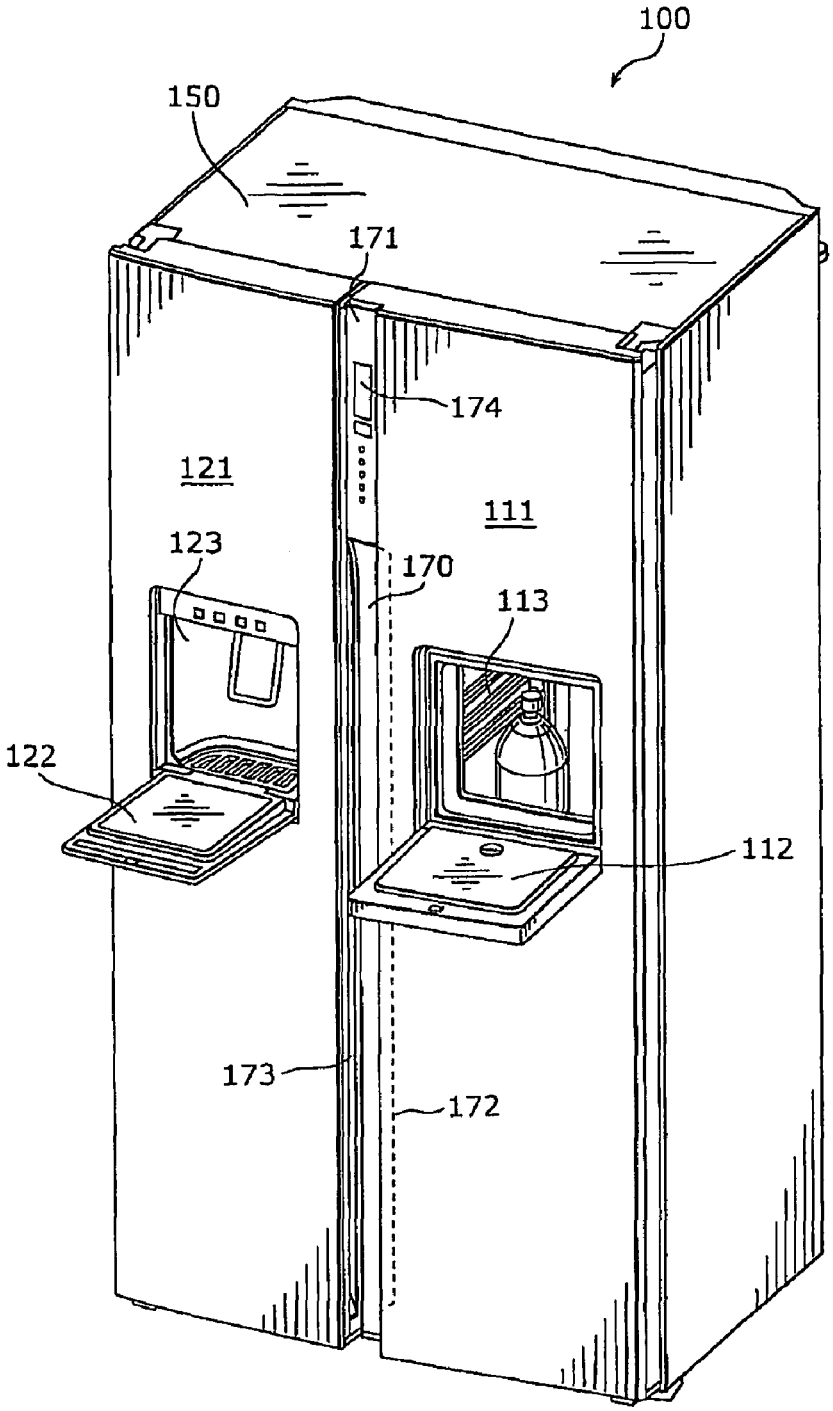
FIG. 2 is an external perspective view of the refrigerator with third and fourth doors open.

FIG. 2 is an external perspective view of the refrigerator with third and fourth doors open.

Figure 3:
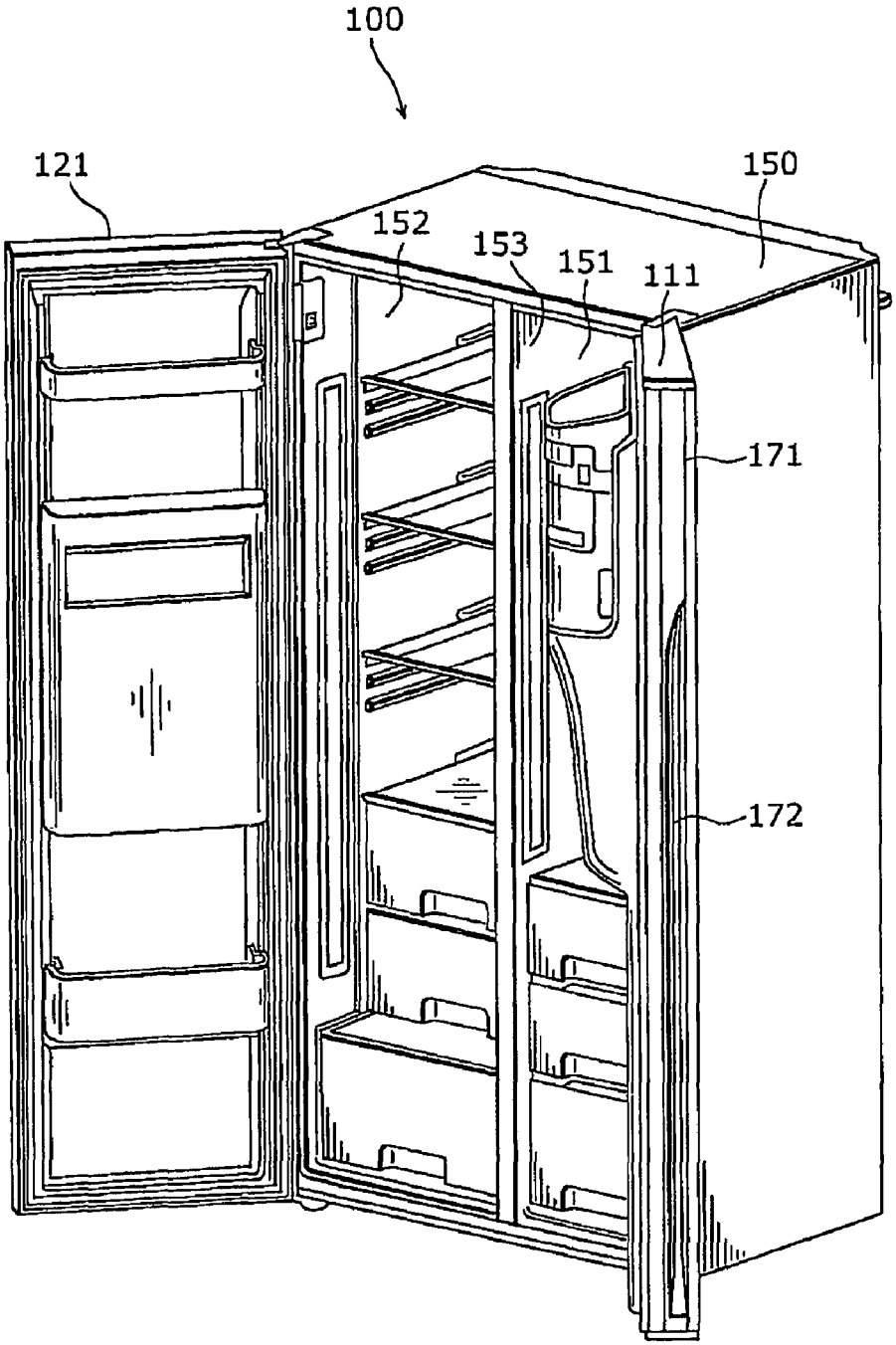
FIG. 3 is an external perspective view of the refrigerator with first and second doors open.

FIG. 3 is an external perspective view of the refrigerator with first and second doors open.

As shown in FIGS. 1 and 2, a refrigerator 100 of the present embodiment includes a heat-insulating main body 150, a first door 111, a second door 121, a third door 112, a through hole 113, a third door 112, a fourth door 122, a concavity part 170, an interface device 171, a first recess part 172, and a second recess part 173.

The heat-insulating main body 150 is a main body with a front side being opened, having heat insulation properties that shut off heat coming in and out of the refrigerator 100.

The divider 153 is a wall separating inside of the heat-insulating main body 150 side by side. In the present embodiment, a right-hand part of the heat-insulating main body 150 divided by the divider 153 is a first storage compartment 151 serving as a refrigerator compartment. On the other hand, a left-hand part of the heat-insulating main body 150 divided by the divider 153 is a second storage compartment 152 serving as a freezer compartment. Here, the second storage compartment 152 has a width smaller than a width of the refrigerator compartment. The divider 153 separates the refrigerator compartment and the freezer compartment, providing heat insulation between the compartments.

The through hole 113 penetrates the first door 111 in the thickness direction. The through hole 113 is a hole through which a user can take storage items out from a space behind the first door 111 without opening the first door 111, or take storage items into the space to be stored therein.

The third door 112 opens and closes at the through hole 113. In the present embodiment, the third door 112 is attached to the first door 111 using a hinge (not shown) so as to turn centering on a horizontal axis arranged along a lower-edge rim of the through hole 113. Furthermore, the third door 112 is substantially square in shape (round-cornered) when viewed from the front, with the axis arranged along a lower-edge rim of the third door 112.

The fourth door 122 opens and closes at a dispenser 123 where the user receives ice or the like supplied from inside of the refrigerator 100.

The first door 111 opens and closes at an opening on the right-hand side of the heat-insulating main body 150. In the present embodiment, the first door 111 is attached to the heat-insulating main body 150 using a hinge (not shown) so as to turn centering on a vertical axis that extends in an anterior portion of the right-side wall of the heat-insulating main body 150. Furthermore, the first door 111 is rectangular in shape when viewed from the front, with the axis extending along the right-edge rim of the first door 111.

Figure 4:
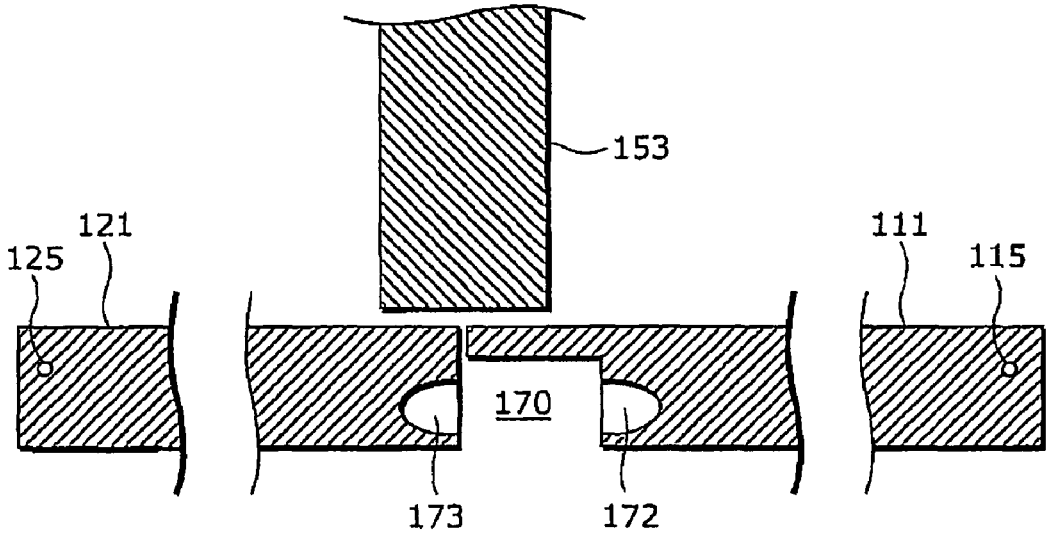
FIG. 4 is a schematic cross-sectional view illustrating a relationship between a divider and a cross section taken along a horizontal line of the first and second doors.

FIG. 4 is a schematic cross-sectional view illustrating a relationship between the divider and a cross section taken along a horizontal line of the first and second doors.

The concavity part 170 is a vertical space provided at a front side of a free end of the first door 111, namely, at an end of a front side of the first door 111 which is located opposite to the axis 115 in a width direction. In the present embodiment, the concavity part is a cuboid in shape and provided along a full vertical length of the first door 111. A width of the concavity part 170 is enough for the user to insert fingers therein and further bend the fingers to be inserted to the first recess part 172, and also enough for the user not to touch by the fingers a free end of the second door 121 when inserting the fingers to the first recess part 172 to open the first door 111.

It should be noted that the concavity part 170 is not limited to be created by removing a part of the free end of the first door 111 that have been already manufactured. It is also possible to form the concavity part 170 when manufacturing the first door 111.

As described above, the forming of the concavity part 170 in the first door 111 having a relatively great width can give the user impression that two doors having the almost same width are arranged symmetrically when the user views the refrigerator 100 with the doors closed from the font. As a result, design of the refrigerator 100 can be improved.

It should also be note that, since the concavity part 170 is located close to an end of the divider 153, reduction in heat insulation properties of the whole first door 111 can be suppressed as much as possible, even if the thickness of the first door 111 is reduced.

The first recess part 172 is a part provided in an edge part of the free end of the first door 111, being recessed in a direction from the concavity part 170 to the axis 115 of the first door 111. The first recess part 172 has a width enough for the user to insert fingers therein, and a depth enough for the user to insert the fingers up to second joints therein.

The second door 121 opens and closes at an opening on the left-hand side of the heat insulating main body 150. In the present embodiment, the second door 121 is attached to the heat-insulating main body 150 using a hinge (not shown) so as to turn centering on a vertical axis that extends in an anterior portion of the left-side wall of the heat-insulating main body 150. Furthermore, the second door 121 is rectangular in shape when viewed from the front, with the axis extending along the left-edge rim of the second door 121.

The second recess part 173 is a part provided in an edge part of the free end of the second door 121, being recessed in a direction from the concavity part 170 to the axis 125 of the second door 121. The second recess part 173 has a width enough for the user to insert fingers therein, and a depth enough for the user to insert the fingers up to second joints therein.

The interface device 171 is a device that conveys information between the user and the refrigerator 100.

For example, the interface device 171 includes a display device that displays a temperature in the refrigerator 100 and thereby notifies the user of information regarding the refrigerator 100. In addition, the interface device 171 includes a switch by which the user can set a desired temperature to adjust the temperature in the refrigerator 100.

In the present embodiment, the interface device 171 also includes a touch screen 174.

The touch screen 174 is a device having: a display device that displays images; and a transparent touch sensor provided at a front side of the display device. Based on signals from the touch sensor, the touch screen 174 can provide the user with information corresponding to the images displayed on the display device.

With the structure, by storing sets of an image and information in association with each other, the touch screen 174 can provide the user with various pieces information without having various switches.

Therefore, even if a space allowed for setting the interface device 171 is small, the touch screen 174 enables the interface device 171 to provide various pieces of information. This is advantageous for the interface device 171 that is provided at the concavity part 170.

In addition, the touch screen 174 enables the interface device 171 to eliminate physical various switches, which makes it possible to reduce a weight of the first door 111 having the interface device 171.

Furthermore, the interface device 171 is a cuboid corresponding to the shape of the concavity part 170, and arranged at an upper end of the concavity part 170 at an upper end of the first door 111.

Thereby, since the interface device 171 is provided at the highest part of the door of the refrigerator, children cannot easily touch the interface device 171. As a result, it is possible to prevent the children from mischief and wrong operation of the interface device 171. Especially when the touch screen 174 is adopted, since the touch screen 174 can be easily operated merely by touching the touch screen 174, the above problem is likely to occur. Therefore, if the touch screen 174 is arranged close to the top part of the door of the refrigerator, the problem can be solved. On the other hand, adults are tall enough to operate such devices, so that the above arrangements does not reduce the handleability of the user. Especially people in the United States of America and Europe are relatively tall, so that the arrangements do not have any problems in the handleability of the user.

Still further, the first door 111 includes a decorative plate 175 to give the user an impression as if the interface device 171 is integrated to the first door 111. The decorative laminate is arranged to cover: an internal rear surface of the concavity part 170 which is gradually curbed out to reach a lower end of the front side of the interface device 171; and a portion of the lower end.

INDUSTRIAL APPLICABILITY

The present invention is applicable to a refrigerator, and more particularly applicable to a refrigerator having a freezer compartment and a refrigerator compartment arranged side by side.

The invention claimed is:

1. A side-by-side refrigerator comprising:

a heat-insulating main body having openings in a front side;

a divider which divides an interior of said heat-insulating main body so as to form side by side a first storage compartment and a second storage compartment having a width smaller than a width of said first storage compartment;

a first door which turns to open and close at said first storage compartment, and has a vertical axis that extends in an anterior portion of a side wall of said heat-insulating main body;

a second door which turns to open and close at said second storage compartment, and has a vertical axis that extends in an anterior portion of a side wall of said heat-insulating main body;

an interface device provided at an upper end of the side-by-side refrigerator, the interface device configured to convey information between a user and the refrigerator;

a concavity part which extends vertically, provided at a free end of said first door and recessed relative to a front surface of said first door;

a first recess part, which the user can engage by inserting a finger thereinto, said first recess part being recessed from said concavity part at a surface of the free end of said first door in a direction toward the axis of said first door, said first recess part being vertically provided along said concavity part, and said first recess part arranged to be hidden by the first door when viewing a front side of the side-by-side refrigerator; and a decorative plate covering an internal rear surface of the concavity part and gradually curving out to reach a lower end of a front side of the interface device.

2. The refrigerator according to claim 1, wherein said interface device includes a touch screen.

3. The refrigerator according to claim 1, further comprising a second recess part which is provided in an edge part of a free end of said second door, and is recessed in a direction from said concavity part to the axis of said second door, wherein said first recess part is provided in an edge part of the free end of said first door.

4. The refrigerator according to claim 1, wherein a user must insert the finger through the concavity part to reach the first recess part.

* * * * *